United States Patent [19]

Ducharme

[11] 3,947,898

[45] Apr. 6, 1976

[54] PORTABLE BIDET

[76] Inventor: Benoit Ducharme, 7393 18th Ave., Montreal H2A 2N4, Quebec, Canada

[22] Filed: Sept. 16, 1974

[21] Appl. No.: 506,563

[52] U.S. Cl. ..... 4/6; 4/185 S

[51] Int. Cl.[2] ..... A47K 3/22; A47K 7/08

[58] Field of Search ..... 4/6, 7, 110, 182, 185 R, 4/185 S, 185 AB, 185 B, 177, 172.17; 128/370; D23/51, 52, 56, 61

[56] References Cited

UNITED STATES PATENTS

| | | | |
|---|---|---|---|
| 1,039,708 | 10/1912 | Denquer | 4/7 UX |
| 2,670,029 | 2/1954 | Rossi | 4/185 S X |
| 3,082,432 | 3/1963 | Pearlman | 4/7 |
| 3,528,112 | 9/1970 | Warnick | 4/6 X |
| 3,812,543 | 5/1974 | Stinson | 4/6 X |

*Primary Examiner*—Houston S. Bell, Jr.
*Assistant Examiner*—Stuart S. Levy
*Attorney, Agent, or Firm*—Raymond A. Robic; Peter G. Mack; Arthur Schwartz

[57] ABSTRACT

A portable bidet for use in conjunction with a conventional bathtub which is of simple construction and inexpensive to manufacture. Since the subject bidet is portable, it is not a permanent fixture in the bathroom and can therefore be used in existing bathrooms which have conventional bathtubs. According to the subject invention, the portable bidet is adapted, in use, to be supported in a conventional bathtub having a bottom and an outer sidewall. The bidet comprises an enclosure-forming body having an open bottom and a top, and means at said top defining a seat for a user. A support bracket is solid with said body in the general plane of said seat and projects away therefrom to be set, in use, on the top of said bathtub sidewall. A support leg is hingedly connected at one end to the body on a side thereof opposite said support bracket and adapted, in use, to rest by the other end on the bottom of said bathtub. The leg is of a size so as completely to close, in put-away position, said open bottom of said body.

8 Claims, 5 Drawing Figures

PORTABLE BIDET

This invention relates generally to a bidet, and more particularly to a portable bidet adapted for use in conjunction with a conventional bathtub.

Known bidets have been utilized in washrooms either as a permanent fixture in itself, or in combination with a toilet installation. Due to the additional space requirements and cost associated with a bidet utilized as a separate fixture, it is evident that a larger washroom would be necessary which would also be more expensive. As such, it would not generally be possible to adapt an existing washroom to the use of such a bidet without encountering a considerable expense. When utilized in combination with an existing toilet installation, the bidet is supported adjacent the toilet bowl by a suitable bracket and is pivotally mounted by said bracket in order to be swung into position on the toilet bowl. In such a case, the bidet always remains in view, even when not in use. The use of the bidet in association with a toilet installation requires the use of several sizes of bidets to accommodate the varied structural designs of toilet bowls presently in use. In addition, the depth of such a bidet is severely limited, especially if the toilet bowl is of shallow construction, and the provision of a spray nozzle thereby restricted.

The subject invention proposes a portable bidet of simple construction and inexpensive to manufacture, which can be utilized in association with existing conventional bathtubs.

According to the present invention, the portable bidet, which, in use, is adapted to be supported in a conventional bathtub, comprises an enclosure-forming body having a bottom with an opening therein, a top with an opening therein, and means at the top defining a seat for a user. The bidet includes a support bracket integral with the body and extending in the general plane of the seat to project away therefrom and to be set, in use, on top of a sidewall of the bathtub. The support bracket includes a slot which is configured to serve as both a carrying handle and a hanging means. The bidet also includes a support leg having a pivot means at one end and a foot portion at the other end, the pivot means being coupled between the one end of the leg and a side of the body opposite to the support bracket. The leg is pivotable between a retracted position wherein the entirety of the leg adjoins the body and an extended position wherein the leg projects from the body and wherein the foot portion of the leg engages the bottom of the bathtub. The size and configuration of the leg corresponds to the size and configuration of the opening in the bottom of the body so that the leg entirely closes the opening when in the retracted position. Included is a wash basin depending from user's seat and entirely contained within the enclosure-forming body spacedly therefrom. The basin, body, and the leg define an enclosed, interior space within the body. Also included is means for connecting the wash basin to a source of water, such water connection means being storable in the interior space when the portable bidet is not in use.

In drawings which illustrate one embodiment of the subject invention:

Figure 5:
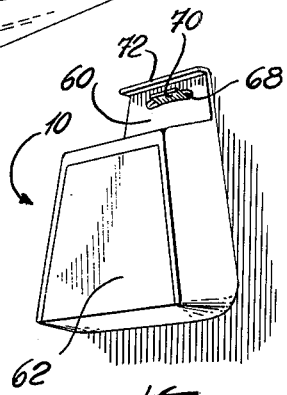
Figure 4:
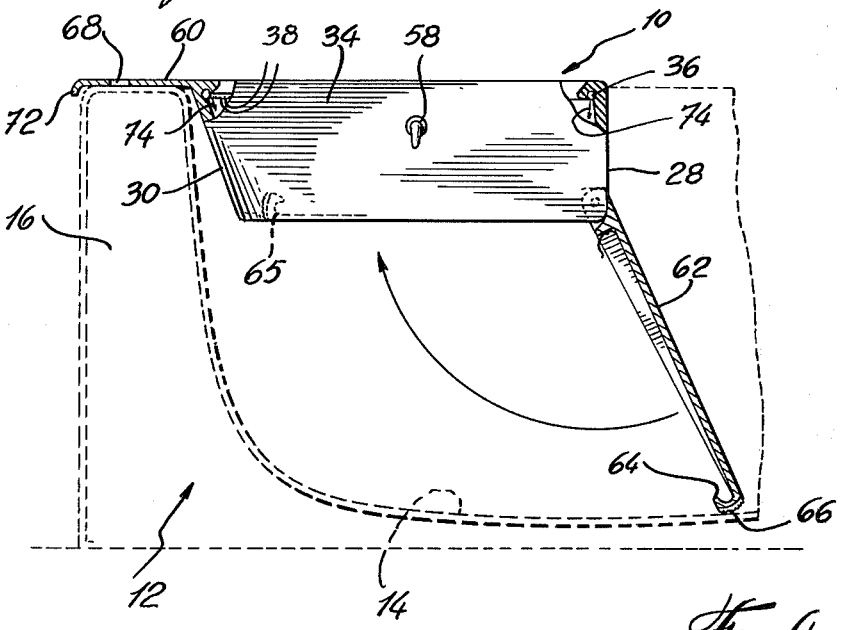

FIG. 4 is a side elevational view of the same embodiment when installed in a conventional bathtub, partly broken away to illustrate a number of the structural details thereof, prior to connecting the removable water supply lines and the removable drain line; and FIG. 5, which appears on the first page of drawings, is a perspective view of the same embodiment when not in use, the portable bidet being supported from a suitable hook.

Figure 1:
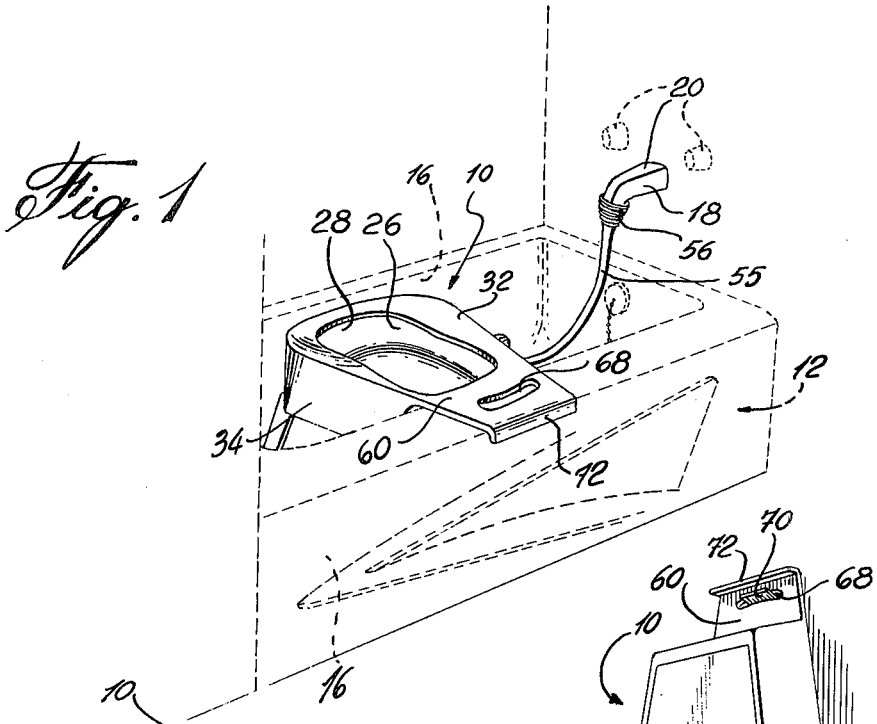
FIG. 1 is a perspective view of one embodiment according to the subject invention, when installed in a conventional bathtub.
Figure 2:
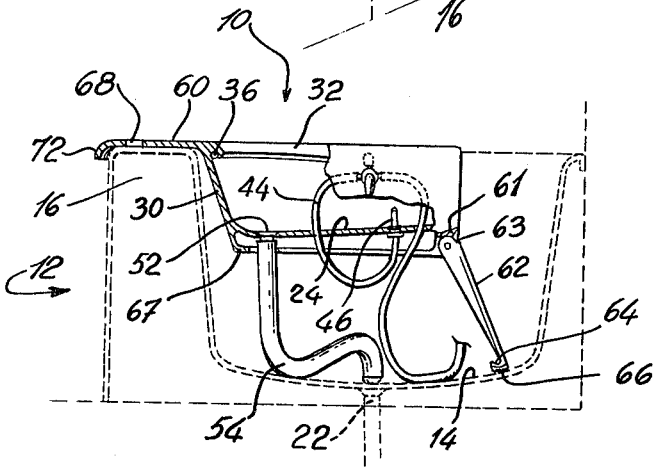
FIG. 2 is a side elevational view of the embodiment of FIG. 1, partly broken away to illustrate the constructional features thereof.
Figure 3:
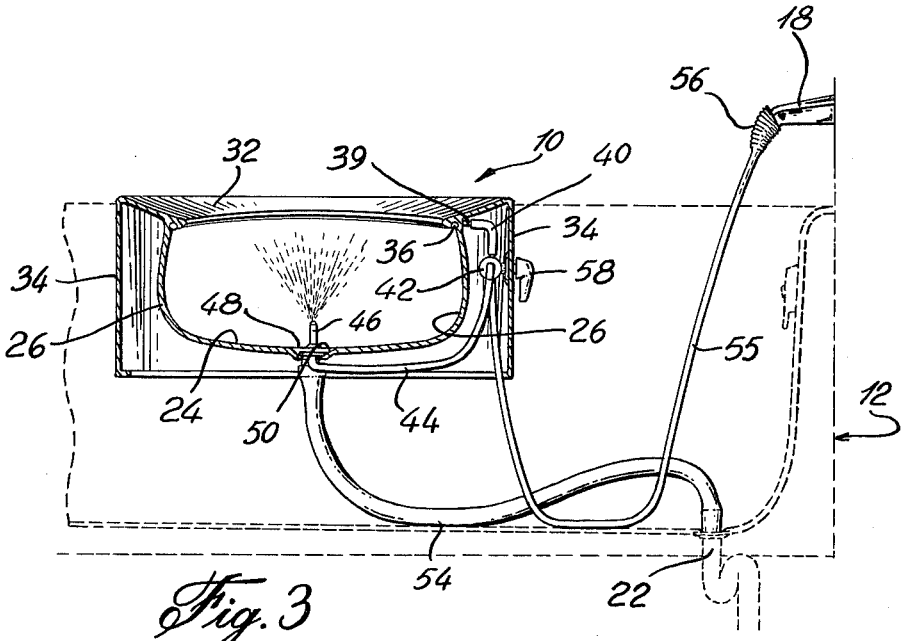
FIG. 3 is an enlarged vertical section of the embodiment of FIG. 2.

FIGS. 1 to 3 of the drawings illustrate the embodiment according to the subject invention when installed in the bathtub, shown in phantom, and ready for use. The portable bidet is indicated generally by reference numeral 10 and is situated in a conventional bathtub 12 having a bottom 14 and side walls 16. The bathtub fixtures include a faucet 18, hot and cold water taps 20 and a drain 22.

The portable bidet 10 includes a bowl portion or wash basin having a bottom wall 24 merging into side walls 26 extending upwardly therefrom. The bottom wall 24 slopes downwardly from a rear end wall 28 to a front end wall 30. A top seat flange 32 is integral with the top of the side walls 26 of the bowl portion and extends therefrom outwardly and upwardly terminating at outer side walls 34. As best seen in FIG. 3, a hollow, enclosed interior space exists within the interior of the bidet intermediate the side walls 26 of the bowl portion and outer side walls 34 of the bidet.

Integral with the top seat flange 32 and extending along the top edge of the side walls 26 is a flush manifold 36 having a plurality of downwardly directed holes 38 therein. An inlet 39 to the manifold 36 is connected by a manifold supply tube 40 to a valve means 42 situated within the bidet intermediate the side walls 26 and the outer side walls 34, as best seen in FIG. 3. A supply line 44 extends from an outlet of the valve means 42 to a lower end of spraying nozzle means 46 situated in the bottom wall 24 of the bowl portion of the bidet 10. The nozzle means 46 includes a flange portion 48 having a downwardly and inwardly tapered periphery which cooperates with tapered side walls of an opening 50 in the bottom wall 24 against which the nozzle means is rigidly secured by any known means. The nozzle means 46 extends upwardly relative to the bottom wall 24 into the bowl portion of the bidet.

At the lowest point of the bottom wall 24, adjacent the front end 30 of the bidet 10 is located a drain 52, as best seen in FIG. 2. Connected to a lower end of the drain 52 is a drain pipe 54 which connects the drain 52 to the bathtub drain 22.

Water is supplied to the nozzle means 46 and the manifold 36 by a flexible tube 55, connected at one end to the faucet 18 and at its other end to an inlet to the valve means 42. The tube 54 has an enlarged funnel-shaped flexible mouth 56 integral therewith at one end thereof to facilitate its attachment to the faucet 18. A stem of the valve means 42 projects outwardly through one of the outer side walls 34 and has a handle 58 secured thereto. By means of the handle 58, a user of the bidet is able to adjust the flow of water from the faucet 18 by shutting it off completely or by directing the flow of water to either the nozzle means 46 or the manifold 36 for flushing, the valve means 42 comprising a three-way valve.

In order to be supported in a conventional bathtub 12, the portable bidet 10 includes a support means comprising a bracket 60 rigidly secured to the bidet and extending outwardly from the top of the front end 30, as well as a wide support leg 62 which is pivotally mounted to the bottom of the bidet adjacent the rear end 28 thereof. An end of the support leg 62 opposite from its pivot point includes a foot portion 64 having a friction means such as resilient friction pad 66 secured to its lower surface. When installed in the bathtub 12, the support leg 62 extends downwardly and away from the portable bidet 10, the friction pad 66 of the foot portion 64 engaging the bottom 14 of the bathtub. Frictional engagement between the pad 66 and the bottom of the bathtub provide vertical support for the rear end 28 of the bidet 12. The bracket 60, which extends outwardly from the front end 30 of the bidet, rests on a side wall 16 of the bathtub. As best seen in FIGS. 1 and 2, the bracket 60 is integral and of one-piece with the top seat flange 32 and extends in a horizontal direction when the portable bidet is situated in a bathtub. As such, bracket 60 provides support for the front end 30 of the bidet.

Also, bracket 60 includes a flange 72 at an end thereof opposite from the front end 30 of the bidet. The flange 72 hooks over the outer surface of the side wall 16 of the bathtub when installed therein, thereby assisting to maintain the bidet in a stationary position.

When the bidet is not in use, the support leg 62 is pivoted about its pivot point to a closed position, wherein the leg 62 is in contact with the outer side walls 34 of the bidet. In this position, support leg 62 forms an outer bottom wall flush with the bottom of the bidet, which together with outer side walls 34, provides a compact enclosure for the bidet when not in use (see FIG. 5). It will further be noted that the inturned end 64 of the leg 62 fits, in such closed position, in a locking slot or groove 65 (FIG. 4) in an inturned part 67 of the front end wall 30. In addition, bracket 60 includes a transverse slot 68 adapted to engage a cooperating hook 70 situated on either a door or wall, thereby facilitating storage of the portable bidet, as best illustrated in FIG. 5.

In order to use the portable bidet, the support leg 62 is first opened outwardly from the bottom of the bidet 10, the support leg extending downwardly and slightly rearwardly from the rear end 28 of the bidet. The bidet 10 is then positioned in the bathtub 12, the friction pad 66 of the support leg 62 resting on the bottom 14 of the bathtub, while the bracket 60 is placed on the top of the side wall 16, such that the flange 72 extend over the outer surface of the side wall 16. The removable drain hose 54 is then connected at one end to the drain 50 of the bowl portion of the bidet and at its opposite end to the bathtub drain 22. The flexible tube 55 is then connected, with its funnel-shaped mouth being secured to the faucet 18 while its opposite end is attached to the inlet end of the valve means 42. A tube 40 is connected from one outlet of the valve means 42 to an inlet to the manifold 36, while a supply line 44 is connected at one end to a second outlet from the valve neans 42 and at its opposite end to a lower end of the nozzle means 46. A desired temperature of the water to be utilized is obtained by adjusting taps 20. Water is introduced into the bowl portion of the bidet 12 by turning handle 58 to a position whereby water coming from the faucet through flexible tube 54 is directed through supply line 44 to the nozzle means 46. FIG. 3 of the drawings illustrates the form of water spray obtained from the nozzle means when the valve means is in this position. To shut off the nozzle spray, the handle 58 is adjusted to an off position, thereby restricting the flow of water through the supply line 44. In order to flush the inner surface of the bowl portion of the bidet, the handle 58 of the valve 42 is moved into a position whereby water coming from the faucet 18 through the flexible tube 54 is directed through tube 40 into the manifold 36. As illustrated in FIG. 4, by arrows 74, water is directed downwardly along the inner surfaces of the side walls 26. In this way, a suitable flushing of the inner surface of the bowl portion is obtained. Accumulated water within the bottom of the bowl portion is drained therefrom by means of a drain 52 connected by a flexible tube 54 to the bathtub drain 22.

Returning again to the leg support 62, the latter may be provided, at the pivoted end with shoulder 63 abutting, in supporting position a cooperating ledge 61 on the sidewall 28. This would add further safety in case the friction pad 66 should fail under the weight of the user.

I claim:

1. A portable bidet adapted, in use, to be supported in a conventional bathtub having a bottom and a sidewall, said bidet comprising:

a. an enclosure-forming body having a bottom with an opening therein, a top with an opening therein, and means at said top defining a seat for a user;

b. a support bracket integral with said body and extending in the general plane of said seat to project away therefrom and to be set, in use, on the top of the bathtub sidewall, said support bracket including a slot which is configured to serve as both a carrying handle and hanging means;

c. a support leg having a pivot means at one end and a foot portion at the other end, said pivot means being coupled between said one end of said leg and a side of said body opposite said support bracket, said leg being pivotal between a retracted position wherein the entirety of said leg adjoins said body and an extended position wherein said leg projects from said body and wherein said foot portion of said leg engages the bottom of the bathtub, the size and configuration of said leg corresponding to the size and configuration of said opening in said bottom of said body so that said leg entirely closes said opening when said leg is in said retracted position;

d. a wash basin depending from said user's seat, said wash basin being entirely contained in said body spacedly therefrom;

e. said basin, said body, and said leg defining an enclosed, interior space within said body;

f. means for connecting said wash basin to a source of water, said water connection means being storable in said interior space when said portable bidet is not in use.

2. A portable bidet as claimed in claim 1, including means both in said support leg and in said body cooperating to lock said leg over said opening in said bottom of said body when said leg is in said retracted position.

3. A portable bidet as claimed in claim 1:

a. wherein said means for connecting said wash basin to a source of water includes a supply line and a flexible tube;

b. including nozzle means in said wash basin;

c. including a valve means communicating with said supply line and said flexible tube and interposed therebetween, one end of said supply line being connected to said nozzle, the other end being connected to said valve means, one end of said flexible tube being connected to said valve means, the other end of said flexible tube being connected to a source of water, whereby said nozzle produces a water spray which may be controlled by said valve means;

d. including a drain in said wash basin and a drain pipe extending from said drain to effect drainage of water therefrom.

4. A portable bidet as claimed in claim 3, including a manifold integral with said top of said body, said manifold extending around said top opening and including a plurality of downwardly directed openings, a manifold supply tube extending from said valve means to said manifold to effect communication therebetween, whereby a flushing spray is obtained from said downwardly directed openings, which spray may be controlled by said valve means.

5. A portable bidet as claimed in claim 4, wherein said valve means is mounted on said body and includes a manual control handle at the exterior of said body, whereby the user may control the flow of water to said manifold and nozzle.

6. A portable bidet as claimed in claim 1, wherein said support bracket is one piece with said body.

7. A portable bidet as claimed in claim 1, wherein said leg, when in said retracted position, is flush with said bottom of said body.

8. A portable bidet as claimed in claim 1, wherein said foot portion of said leg includes friction means for grippingly engaging the bottom of the bathtub to prevent slippage of said leg.

* * * * *